United States Patent [19]

Samejima et al.

[11] Patent Number: 4,925,398

[45] Date of Patent: May 15, 1990

[54] CONNECTOR

[75] Inventors: Masakuni Samejima; Kiyohito Fukuda; Mitsuru Matsumoto, all of Shizuoka, Japan

[73] Assignee: Yazaki Corporation, Japan

[21] Appl. No.: 267,370

[22] Filed: Nov. 4, 1988

[30] Foreign Application Priority Data

Nov. 6, 1987 [JP] Japan ..... 62-169859[U]

[51] Int. Cl.[5] ..... H01R 13/627

[52] U.S. Cl. ..... 439/357; 439/350

[58] Field of Search ..... 439/347–358

[56] References Cited

U.S. PATENT DOCUMENTS

| | | | |
|---|---|---|---|
| 3,933,406 | 1/1976 | Cameron | 439/358 |
| 4,010,998 | 3/1977 | Tolnar, Jr. et al. | 339/91 |
| 4,026,624 | 5/1977 | Boag | 439/357 |
| 4,211,461 | 7/1980 | Wescott | 439/357 |

*Primary Examiner*—David Pirlot

*Attorney, Agent, or Firm*—Wigman & Cohen

[57] ABSTRACT

Disclosed herein is a connector which comprises a female housing and a male housing to be fitted to said female housing for electrical connection therebetween. The connector has a locking structure including a locking arm having a locking edge portion provided on one of the housings and a locking projection provided on the other housing. The locking arm is flexibly supported on either the female or male housing and the locking projection is provided so as to be locked with the locking edge portion when the female and male housings are properly fitted together. The locking projection is constructed so as to camber the locking arm when the male housing is inserted into the female housing, thereby causing a restoring force to be generated in the locking arm. Further, the locking structure includes a member for increasing the restoring force to secure the fitting between the locking edge portion and locking projection without increasing the force required to disengage the locking structure.

4 Claims, 5 Drawing Sheets

CONNECTOR

BACKGROUND OF THE INVENTION

1. Field of the Invention

This invention relates to a connector having a female housing and a male housing that is inserted and fitted into the female housing, and in particular to a connector having an improved locking structure which improves the fitting force between the female and male housings.

2. Description of the Prior Art

Generally, as shown in FIG. 1, a conventional connector 1 comprises a female housing 3 and a male housing 5 to be fitted into the female housing 3. In the female housing 3 there are provided a plurality of terminal accommodating compartments 9 in which the female terminals connected to wires are accommodated, respectively. Similarly, in the male housing 5 there are provided a plurality of male terminal accommodating compartments (not shown) in which male terminals (not shown) are accommodated, respectively, so as to make electrical contact with the female terminals when the female and male housing are fitted together.

On the upper surface of the outer wall 3*a* of the female housing 3, there is formed a U-shaped notch 10 which extends toward the insertion direction of the male housing 5. Further, on the upper surface of the outer wall 3*a* of the female housing 3, a locking arm 11 is provided. The locking arm 11 is a substantially C-shaped member having two leg portions 11*a* and a locking portion 11*b* integrally formed between the leg portions 11*a*. The locking arm 11 is provided so as to protrude over the notch 10 by attaching the tip portions of the leg portions 11*a* onto the upper surface 3*a* of the female housing 3. With this configuration, the locking arm 11 has a locking aperture 11*c* defined by the leg portions 11*a* and the locking portion 11*b*. Further, the locking arm 11 is flexibly supported to the female housing 3 at the tip portions of the leg portions 11*a*.

On the upper surface 5*a* of the outer wall of the male housing 5, there is formed a locking projection 13 to be locked with the locking aperture 11*c* of the locking arm 11 when the female and male housings 3, 5 are fitted together. As can be seen in FIG. 2, the locking projection 13 has a substantially triangular shape in cross section; that is, a first inclined surface 13*a* that declines toward the insertion direction of the male housing 5, a second inclined surface 13*b* that declines toward the opposite direction and a vertical surface 13*c*. The vertical surface 13*c* of the locking projection 13 engages with the inside surface of the locking portion 11*b* of the locking arm 11 when the female and male housings 3, 5 are properly fitted together.

Namely, when the male housing 5 is inserted into the female housing 3, the outer edge 11*d* of the locking edge portion 11*b* is abutted on the first inclined surface 13*a* of the locking projection 13. Then, the locking edge portion 11*c* is gradually lifted along the inclined surface 13*a* as the male housing 5 is inserted into the female housing 3, which causes the locking arm 11 to become cambered, thereby generating a restoring force within the locking arm 11. After the locking edge portion 11*b* of the locking arm 11 crosses the peak 13*d* of the projection 13, the locking edge portion 11*c* is suddenly lowered along the second inclined 13*b* due to the restoring force in the locking arm 11. Thereafter, as shown in FIGS. 2 and 3, the inside surface 11*e* of the locking edge portion is in engagement with the vertical surface 13*c* of the locking projection 13. Such an engagement occurs when the male housing 5 is perfectly fitted to the female housing 3.

However, in this conventional connector, the restoring force in the locking arm may be insufficient to attain a perfect locking condition with the locking projection, and thus an imperfect fitting may occur between the male housing 5 and the female housing 3. This leads to disadvantages such as poor electrical connection in the connector and increased chances that the housings may come apart.

In order to overcome the disadvantages of the conventional connector, one might simply conceive of increasing the restoring force in the locking arm. However, this would make it more difficult to remove the fitted housings from each other due to the extra force required to disengage the locking arm from the locking projection.

SUMMARY OF THE INVENTION

In view of the foregoing disadvantages, this invention has been made. Accordingly, an object of this invention is to provide a connector comprising a female housing and a male housing to be fitted to the female housing by the engagement of a locking arm with a locking projection, in which a perfect fitting between the the locking arm and locking projection can be easily obtained by improving the restoring force of the locking arm without increasing the force required to disengage the locking arm from the locking projection when the housings are to be removed from each other.

In order to accomplish this object, the connector of the present invention comprises a female housing and a male housing to be fitted to the female housing for electrical connection therebetween. The connector further has a locking structure including a locking arm with a locking edge portion provided on one of the housings, and has a locking projection provided on the other housing. The locking arm is flexibly supported on either the female or male housing, and the locking projection is provided so as to become locked with the locking portion when the female and male housings are properly fitted together.

Structurally, the locking projection is constructed so as to camber the locking arm when the male housing is inserted into the female housing, and thus gives rise to a restoring force being generated in the locking arm. Further, the locking structure includes a means for increasing the restoring force in order to secure the lock between the locking portion and the locking projection without increasing the force required to disengage the lock therebetween.

According to the connector having the above structure, a restoring force increasing means is provided to achieve a secure fitting of the male and female housings without causing any change in the force required to disengage the lock between the locking arm and the locking projection. Therefore, with the provision of the restoring force increasing means it is now possible to prevent poor electrical connections from occurring between the terminals of each housings, and it is further possible to prevent the male and female housings from coming apart.

Furthermore, it is preferred that the locking projection have a substantially rectangular shape in cross section, in which the shape has a first inclined surface that declines toward the insertion direction of the male housing and a second inclined surface that declines toward the opposite direction to that of the first inclined surface. Where the first and second inclined surfaces meet is formed the peak of the projection, and when the locking arm reaches this peak the restoring force correspondingly reaches its maximum value.

In one embodiment, the restoring force increasing means comprises an additional locking portion with a V-shaped notch provided on the locking portion at the side of the locking aperture and a wedge-shaped portion formed on the second inclined surface of the locking projection. In this embodiment, the wedge-shaped portion is constructed so as to mate with the V-shaped notch.

According to the connector having the simple structure mentioned above, it is possible to attain the aforementioned object. Namely, by the provision of the additional locking portion, the maximum restoring force of the locking arm is obtained at a position where the peak of the projection makes contact with the additional locking portion. Such a position is closer to the mounting location of the leg portions of the locking arm than that for the conventional connector by a distance equal to the width of the additional locking portion. Therefore, the restoring force generated in the locking arm is larger than that for the conventional case.

On the other hand, when the locking arm and the locking projection are to be disengaged, it is sufficient to merely lift the locking arm to a position where the V-shaped notch of the additional locking portion engages with the wedge shaped portion. The position where such an engagement occurs is substantially the same as that for the conventional locking structure. Therefore, the improvement of the restoring force of the locking arm does not increase the force required to disengage the locking arm from the locking projection.

BRIEF DESCRIPTION OF THE DRAWINGS

The objects and advantages of the present invention, as well as the details of the preferred embodiment, will be more fully understood when taken in conjunction with the following drawings, in which.

DETAILED DESCRIPTION OF THE PREFERRED EMBODIMENT

Figure 1:
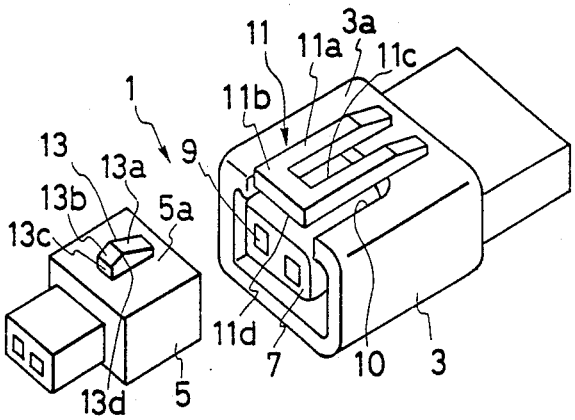
FIG. 1 PRIOR ART
FIG. 1 is a perspective view of a conventional connector.

Referring now to the drawings, the preferred embodiment of the present invention will be described. However, it should first be noted that the structures of the male and female housings of the connector of this embodiment are essentially the same as those for conventional connectors; the difference over conventional connectors residing instead in the locking structures of the locking arm and the locking projection. Therefore, any detailed description of the male and female housings has been omitted. In addition, please note that the same number will be used to designate the same part in all the drawings.

Figure 4:
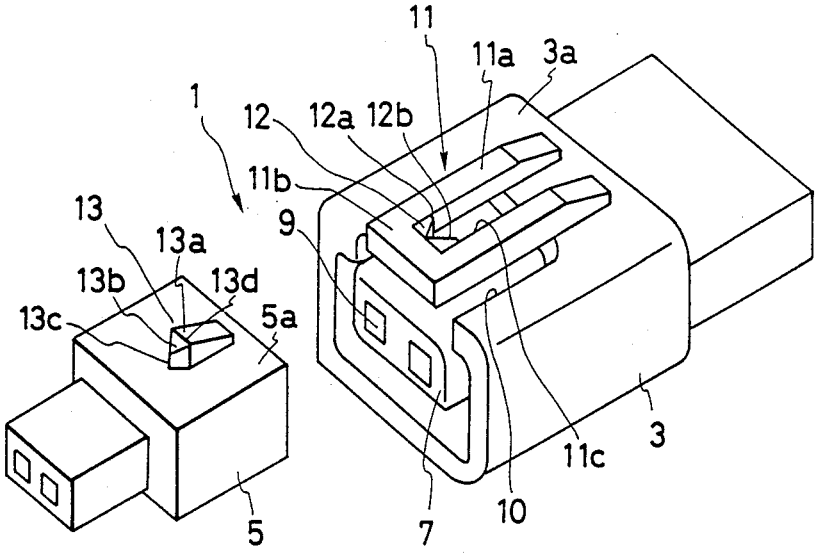
FIG. 4 is a perspective view of the connector of the present invention.

First, as shown in FIG. 4, the preferred embodiment comprises a connector 1 having a female housing 3 and a male housing 5 to be fitted into the female housing 3. On the upper surface 3*a* of the outer wall of the female housing 3, a locking arm 11 is provided, which is made from electrical resistive flexible resin material.

The locking arm 11 comprises a substantially C-shaped member having two leg portions 11*a* and a locking portion 11*b* integrally formed between the leg portions 11*a*, in the same manner as the locking arm 11 of the conventional connector. The locking arm 11 is mounted on the female housing so as to protrude above a notch 10 formed on the upper surface 3*a* of the female housing 3 by attaching the tip portions of the leg portions 11*a* onto the upper surface 3*a*. Provided as such, the locking arm has a locking aperture 11*c* defined by the leg portions 11*a* and the edge portion 11*c*. Further, the locking arm 11 is flexibly supported to the female housing 3 at the tip portions of the leg portions 11*a*.

On the inside of the locking portion 11*b*, there is integrally formed an additional locking portion 12 having rear edges 12*a* and a V-shaped notch 12*b* formed between the edges 12*a* so as to open towards the side of the locking aperture 11*c*. The vertex of the V-shaped notch 12*b* extends towards the locking edge portion 11*b*. The additional locking portion 12 has a characteristic width, and the restoring force in the locking arm is increased in accordance with an increase in the width thereof.

Figure 5:
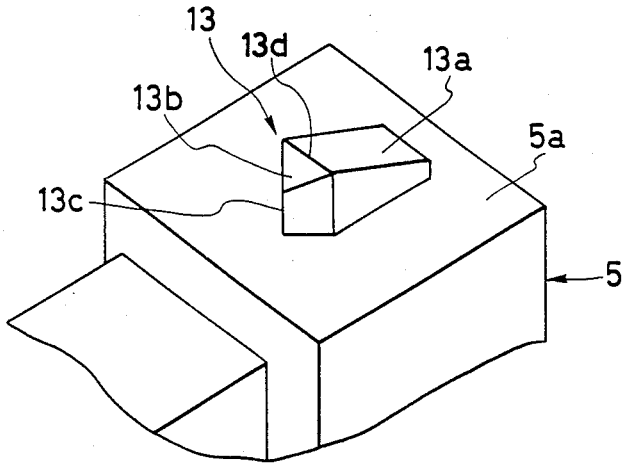
FIG. 5 is a partially enlarged perspective view of the male housing of the connector of FIG. 4.
Figure 6:
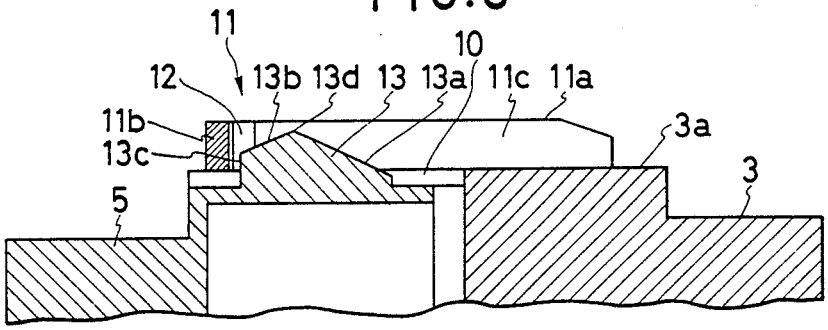
FIG. 6 is a cross-sectional view showing the main part of a locking structure of the connector of the present invention.
Figure 7:
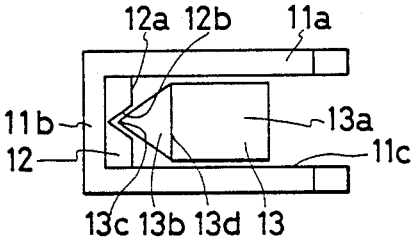
FIG. 7 is an overhead view of the locking structure in FIG. 4.

Now, on the upper surface 5*a* of the outer wall of the male housing 5, there is provided a locking projection 13 to be engaged with the locking aperture 11*c* of the locking arm 11 when the female and male housings 3, 5 are fitted together. The locking projection 13 has, as shown in FIG. 5, a substantially triangular shape in cross section, which comprises a first side with a first inclined surface 13*a*, a second side with a second inclined surface 13*b* and a vertical edge 13*c* formed on the tip of the second side of said projection 13. The first inclined surface 13*a* declines toward the insertion direction of the male housing 5, on which the front edge 11*d* of the locking edge portion 11*c* is slidably abutted when the male housing 5 is inserted into the female housing 3. The second inclined surface 13*b* declines in a direction opposite that for the first inclined surface 13*a*, and this surface is abutted by the inner edge of the additional locking edge portion 12.

Further, as shown in FIGS. 4 through 7, the second inclined surface 13*b* of the projection 13 is formed as a wedge-shape to be mated with the V-shaped notch 12*b* of the additional locking portion 12. When the female and male housings 3, 5 are properly fitted together, the vertical edge 13*c* of the locked projection 13 is in engagement with the vertex of the V-shaped notch 12*b* of the additional locking edge portion 12.

Hereinafter, in accordance with FIGS. 8 and 9, the locking process of the locking structure comprising the locking arm 11 and locking projection 13 of this embodiment will be described in comparison with that of the conventional connector.

Figure 8A:
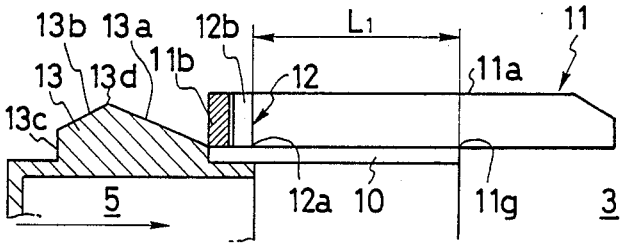
FIGS. 8(A) to 8(D) are explanatory drawings showing the locking condition of the locking structure of the present invention.
Figure 8B:
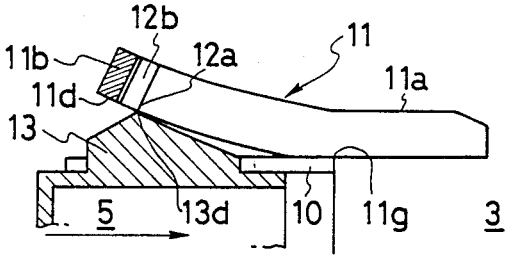
Figure 9A:
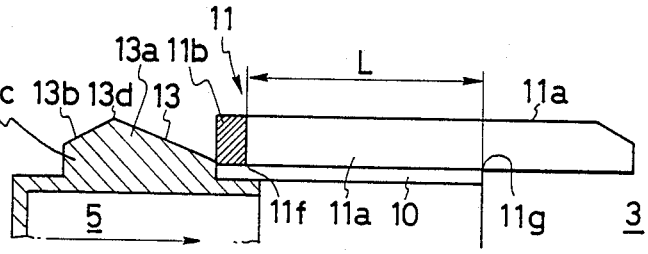
FIG. 9(A) PRIOR ART
FIGS. 9(A) to 9(D) are explanatory drawings showing the locking condition of a locking structure of a conventional connector.

In the locking structures of both the conventional connector and the connector of the present invention, as show in FIG. 9(A) and FIG. 8(B), respectively, when the male housing 5 is inserted into the female housing 3, the front edge 11*d* of the locking edge portion 11*b* is abutted on the first inclined surface 13*a* of the locking projection 13. Then, the locking edge portion 11*b* is gradually lifted along the inclined surface 13*a* in accordance with the insertion of the male housing 5, so that the locking arm 11 is cambered, whereby a restoring force is generated in the locking arm 11.

Figure 9B:
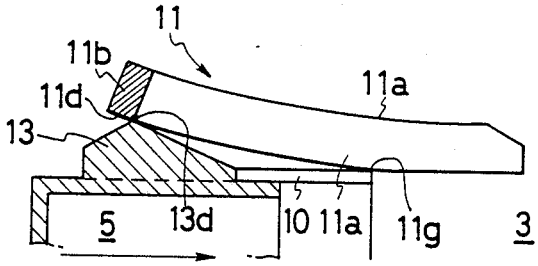
FIG. 9(B) PRIOR ART

According to the locking structure of the present invention, the restoring force reaches a maximum when the rear edges 12*b* of the additional locking portion 12 reach the peak 13*d* of the locking projection 13, as shown in FIG. 8(B). On the other hand, according to the conventional locking structure, as shown in FIG. 9(B), the restoring force reaches a maximum when the rear edge 11*f* of the locking portion 11 reaches the peak 13*d* of the locking projection 13.

Namely, according to the present invention, the maximum camber of the locking arm is obtained at the position where the rear edges 12*a* of the additional locking portion 12 make contact with the peak 13*d* of the locking projection 13. The position where this occurs is closer to the mounting location of the leg portions 11*a* to the female housing 3 than that for the conventional connector by a distance equal to the width of the additional locking edge portion 12. This means that, according to the present invention, the restoring force generated in the locking arm 11 is increased over that for the conventional locking structure. Consequently, the force securing the locking arm 11 to the locking projection 13 is also increased over that for the conventional case.

The difference between the locking structures of the present invention and the conventional connector will be more clearly understood in view of the following formulas. Please note that the length of the locking arm 11, the height of the projection 13 and the material used for the locking arm 11 are the same for both the connector of the present invention and the conventional connector.

In FIG. 9(A), if the distance between the rear edge 11*f* of the locking portion 11*b* and the mounting part 11*g* of the locking arm 11 to the female housing 3 is defined by "L", and the value of the maximum restoring force is defined by "F", the moment of force "M" is represented by the formula: $M=F\times L$. Similarly in FIG. 8(A), if the distance between the mounting part of the locking arm 11 and the rear edges 12*a* of the additional locking portion 12 is defined by "$L_1$", and the value of the maximum restoring force is defined by "$F_1$", then the moment of force "$M_1$" is represented by the formula: $M_1=F_1\times L_1$. In this case, $M=M_1$ and $L>L_1$. Therefore, $F_1>F$, thus indicating that the restoring force in the locking arm 11 of the present invention is larger than that for the conventional connector.

Figure 2:
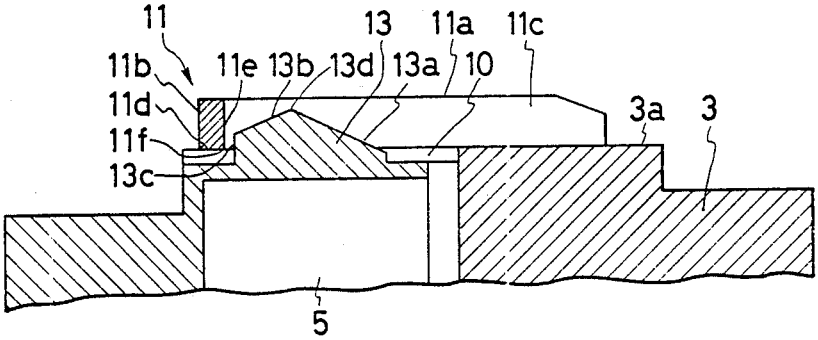
FIG. 2 PRIOR ART
FIG. 2 is a cross-sectional view showing the main part of a locking structure of the connector of FIG. 1.
Figure 3:
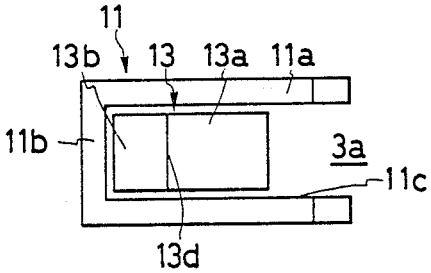
FIG. 3 PRIOR ART
FIG. 3 is an overhead view of the locking structure of the connector of FIG. 1.
Figure 9C:
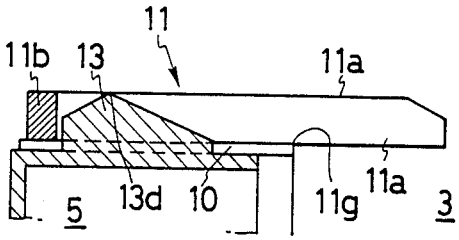
FIG. 9(C) PRIOR ART
Figure 9D:
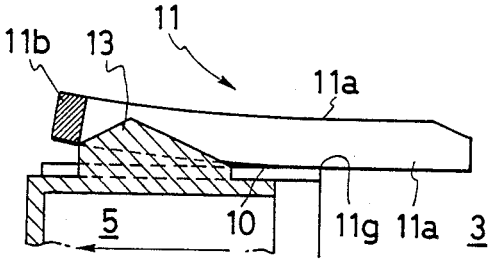
FIG. 9(D) PRIOR ART

In conventional locking structures, when the rear edge 11*f* of the locking portion 11 crosses the peak 13*d* of the projection 13, the locking portion 11*b* is suddenly lowered along the second inclined surface 13*b* by the restoring force in the locking arm 11. Then, as shown in FIGS. 2, 3 and 9(C), the locking portion 11*b* is in engagement with the vertical surface 13*c* of the locking projection 13. In this case, the male housing 5 is perfectly fitted into the female housing 3.

Figure 8C:
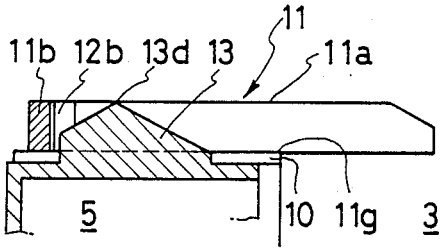

On the other hand, according to the locking structure of the present invention, when the rear edges 12*a* of the additional locking portion 12 cross the peak 13*d* of the projection 13, both the locking portion 11*b* and the additional locking portion 12 are lowered along the second inclined surface 13*b*. Then, as shown in FIG. 8(C), the V-shaped notch 12*b* of the additional locking portion 12 is mated with the wedge-shaped projection 13, so that the locking arm 11 is in engagement with the locking projection 13. In this case, please note that the vertical edge of the wedge-shaped portion 13*c* resides in the vertex of the V-shaped notch 12*b*.

Figure 8D:
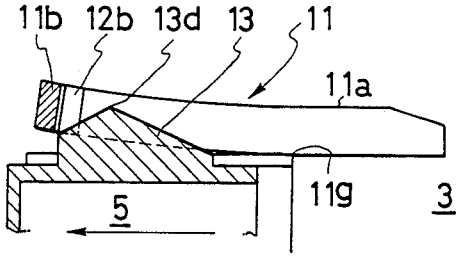

Now, when the locking arm 11 and the locking projection 13 of the locking structure of the present invention are to be disengaged from each other, it is sufficient to merely lift the locking arm 11 to the position where the engagement between the V-shaped notch 12*b* and the wedge-shaped portion of the projection 13 initially began to take place, as shown in FIG. 8(D). This position is substantially the same as that for the conventional locking structure. Next, the male housing is drawn toward the direction indicated by the arrow "X", which then disengages the locking arm 11 from the locking projection 13. As a result of such a structure, the forces required to disengage the locking structures of both the conventional connector and the connector of the present invention are substantially the same.

In the embodiment described above, the angles of the first and second inclined surfaces, the height of the projection and the width of the additional locking portion can be varied to change the restoring force of the locking arm. Moreover, the shape of the notch in the additional locking portion and the shape of the projection are not limited to those of the above embodiment.

Finally, it must be understood that the invention is in no way limited to the above embodiment and that many changes may be brought about therein without departing from the true scope of the invention as defined by the appended claims.

What is claimed is:

1. A connector, comprising:

a female housing;

a male housing to be inserted and fitted into said female housing for establishing electrical connection therebetween;

a locking arm comprising a C-shaped member of flexible resin material having two leg portions and a first locking portion with a contact surface area, the first locking portion being provided between the leg portions, and said locking arm being flexibly supported to said female housing;

a locking projection provided on said male housing so as to engage and lock with said first locking portion when said female and male housings are properly fitted together, and said locking projection having first and second sides and having a first inclined surface provided on the first side of said projection and declining toward the insertion direction of said male housing and a second inclined surface provided on the second side of said projection and declining toward the opposite direction, and a peak being formed between the first and second surfaces, and the second side of said projection being formed into a wedge-shape; and a second locking portion provided inside the first locking portion of said locking arm for increasing a thickness of said first locking portion of said locking arm, and said second locking portion having a rear edge and a V-shaped notch which is to be mated with the wedge-shaped second side of said locking projection;

whereby when said male housing is inserted into said female housing, said locking arm is gradually cambered by a sliding contact of the contact surface area of said first locking portion with the first inclined surface of the locking projection so as to generate a restoring force in said locking arm until the rear edge of said second locking portion passes over the peak of the locking projection, at the time the restoring force reaches maximum, and when the rear edge of said second locking portion passes over the peak of said locking projection, the locking arm is suddenly restored to its original position so that the V-shaped notch is mated with the wedge-shaped second side of the locking projection, thereby ensuring a fitting between said locking arm and locking projection, and whereby said locking arm can be disengaged with the locking projection by lifting the locking arm until the V-shaped notch is disengaged from the wedge-shaped second side of the locking projection and then pulling apart the fitted housings.

2. A connector as claimed in claim 1, wherein said first locking portion and said second locking portion are integrally formed on said locking arm.

3. A connector as claimed in claim 1, wherein said second locking portion is formed from a separate part from said first locking portion.

4. A connector as claimed in claim 3, wherein a vertex of the V-shaped notch of the second locking portion extends to the first locking portion of the locking arm.

* * * * *